US008881630B2

(12) United States Patent
Jones

(10) Patent No.: US 8,881,630 B2
(45) Date of Patent: Nov. 11, 2014

(54) STRAPPING MATERIAL DISPENSER WITH INTEGRATED CUTTER

(75) Inventor: Jeffrey M. Jones, Tigard, OR (US)

(73) Assignee: Case N Cut, Inc., Wilsonville, OR (US)

( * ) Notice: Subject to any disclaimer, the term of this patent is extended or adjusted under 35 U.S.C. 154(b) by 316 days.

(21) Appl. No.: 13/253,843

(22) Filed: Oct. 5, 2011

(65) Prior Publication Data

US 2013/0087030 A1 Apr. 11, 2013

(51) Int. Cl.

| | |
|---|---|
| ***B26D 1/08*** | (2006.01) |
| ***B26D 5/10*** | (2006.01) |
| ***B26D 5/22*** | (2006.01) |
| ***B65H 35/06*** | (2006.01) |

(52) U.S. Cl.
USPC ..... 83/436.3; 83/436.5; 83/436.8; 83/444; 83/649; 83/949

(58) Field of Classification Search
USPC ..... 83/203–205, 436.5, 436.8, 649, 436.3, 83/444, 448–450, 588, 627, 636, 949, 83/950; 118/41, 42; 156/577, 579; 72/331
See application file for complete search history.

(56) References Cited

U.S. PATENT DOCUMENTS

| | | | | |
|---|---|---|---|---|
| 2,612,425 | A * | 9/1952 | Jacobson | 83/232 |
| 2,684,655 | A * | 7/1954 | Kuhnle | 118/42 |
| 3,466,963 | A * | 9/1969 | Palson et al. | 83/226 |
| 3,656,430 | A | 4/1972 | Olsson | |
| 3,798,108 | A * | 3/1974 | Ioannilli | 156/510 |
| 4,640,167 | A * | 2/1987 | Stusack et al. | 83/649 |
| 5,207,860 | A | 5/1993 | Klaassen et al. | |
| 6,176,409 | B1 | 1/2001 | Lee | |
| 7,540,225 | B2 | 6/2009 | Lee | |
| 2007/0193426 | A1 | 8/2007 | Lee | |
| 2009/0282961 | A1 | 11/2009 | Jones et al. | |

* cited by examiner

*Primary Examiner* — Clark F. Dexter
(74) *Attorney, Agent, or Firm* — Chernoff, Vilhauer, McClung & Stenzel LLP

(57) ABSTRACT

A dispenser for dispensing a selectable amount of material from an amount of stored material. The dispenser includes a housing having a material track and material storage area, a material-advancement mechanism disposed within said housing, a material-cutting, mechanism, and an actuator. The actuator has a first end being operatively engaged with said first mechanism and an opposing second opposing end being operatively engaged with said second mechanism. The actuator is spring-biased to a non-compressed position via at least first and second springs and is also selectably shiftable to a selectable, material-advancement position and a selectable, material-cutting position.

11 Claims, 5 Drawing Sheets

STRAPPING MATERIAL DISPENSER WITH INTEGRATED CUTTER

FIELD OF INVENTION

This invention relates to dispensers, and specifically to a dispenser suitable for use with flexible material formed in long and relatively thin and narrow strips, suitable for coiling, such as plumber's strapping.

BACKGROUND OF THE INVENTION

Plumber's strapping, also called plumber's "tape" or "hanger strap," is used to secure or suspend water supply lines, drain, waste and vent pipes from walls, floors and framing members. There are two common types of plumber's strapping: plastic strapping and metal strapping. The metal strapping requires the use of fairly heavy snippers to cut the tape to a desired length, which can result in sharp edges, which are conducive to scratching a user's hands. Thus, the metal tape has been largely replaced by a polymer version thereof, which is easier to work with and which is considerably cheaper. Both types consist of a strip of approximately one inch wide material having perforations spaced evenly along the length thereof. The polymer strapping is typically sold in tightly coiled rolls and packaged in thin, flexible plastic. While the polymer strapping is less likely to injure a user and is much easier to cut than the metal strapping, upon removal from the packaging it tends to un-coil and tangle, resulting in user frustration, and wastage of material.

Thus, what is needed is a means for a user to conveniently store a coil of polymer plumber's strapping, or other flexible, coiled material, without the coil becoming loose or tangled, while enabling the user to easily measure and cut a desired length of strapping.

BRIEF SUMMARY OF THE INVENTION

The present disclosure provides an answer to the aforementioned need for an improved means for storing, dispensing and cutting plumber's strapping.

According to one aspect of the disclosure, a dispenser for dispensing a desired amount of material from an amount of stored material includes a housing having a material track, a material storage area, a material-advancement mechanism disposed within said housing, a material-cutting mechanism disposed within the housing, and an actuator. The actuator has a first end operatively engaged with the material-advancement mechanism and an opposing second end operatively engaged with the material-cutting mechanism. The actuator is spring-biased to a standby position via at least one spring and is movable between the extended position, a material-advancement position, and a material-cutting position. Moving the actuator from the extended position to the material advancement position engages the material advancement mechanism. Moving the actuator into the material cutting position engages the cutting mechanism.

The foregoing and other features of the disclosed material dispenser with integrated cutting mechanism will be more readily understood upon consideration of the following detailed description of an embodiment of the material dispenser taken in conjunction with the accompanying drawings.

DETAILED DESCRIPTION OF PREFERRED EMBODIMENT

Figure 1:
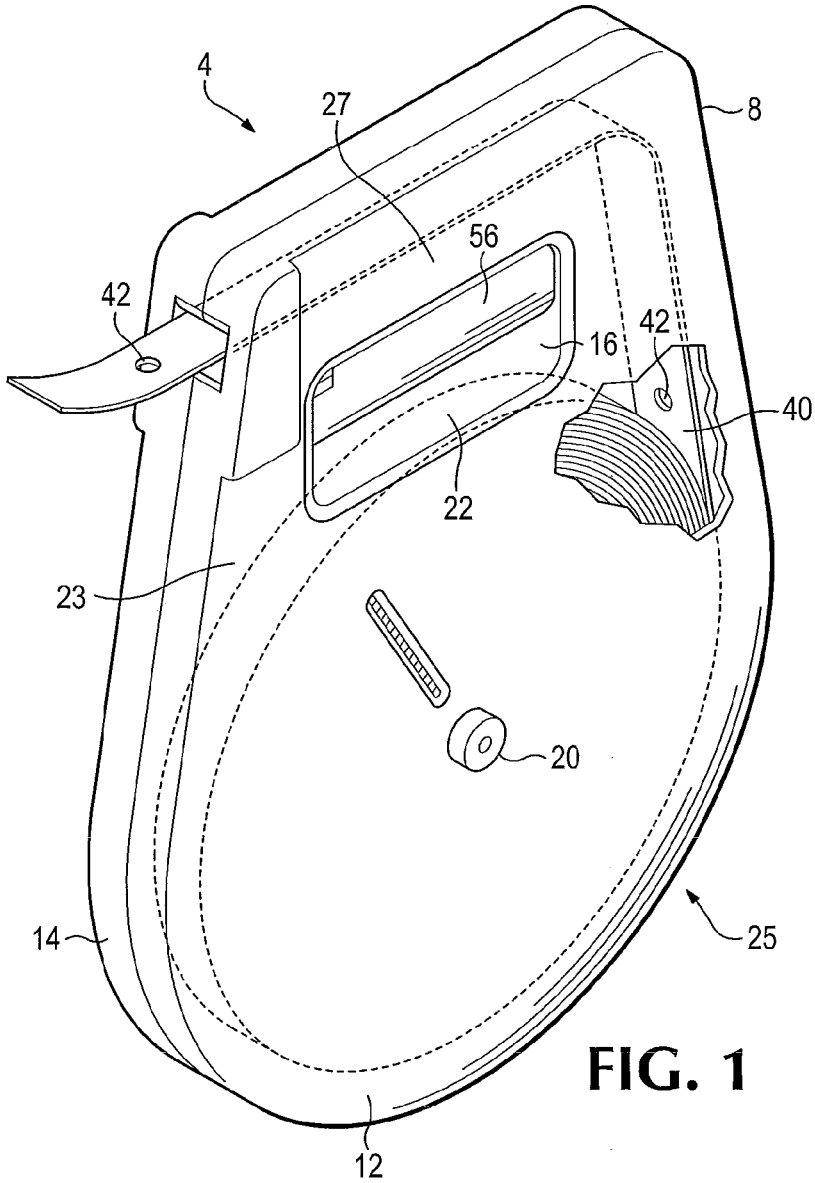
FIG. 1 is an isometric view of an embodiment of the material dispenser described and claimed herein, with a portion broken away to show detail.

Referring to the accompanying drawings, which form a part of the disclosure herein, an embodiment of a material dispenser 4 is depicted in FIGS. 1-9. Referring to FIG. 1, the illustrated embodiment of the dispenser 4 includes a clamshell like case 8 including shell halves 12 and 14, which may be held together by a fastener, such as nut-and-bolt combination 20. The shell halves 12, 14 are formed with matching openings such that when the dispenser 4 is assembled, a single opening 16 is provided to allow gripping of the dispenser 4. The dispenser 4 is divided into a material storage section 25, below the opening 16, and a material advancement and cutting section 27, above the opening 16. In use, a roll of material 40 to be selectively dispensed is placed in the case 8 and threaded through a material track 44 therein, after which the halves are fastened together. The material 40 may be an injection molded solid, woven material, or any suitably flexible material formed in long and relatively thin and narrow strips, suitable for coiling, and may further have perforations 42, such as the Plastic Plumbers Tape, manufactured by the William H. Harvey Company of Omaha, Nebr.

Referring to FIGS. 2-7, the material track 44 is defined by a lower track guide 45 and an upper track guide 46, disposed adjacent to one another in the material advancement and cutting section 23. A material advancement mechanism 48 and a material cutting mechanism 52 are secured to the rear and forward ends of the upper and lower track guides respectively. Both mechanisms 48, 52 are in communication with a dual-purpose actuator 56 captured in the case 8 below the lower track guide 45 and extending into the opening 16. In the embodiment shown in the drawings, the actuator 56 is biased to an extended position by a material advancement spring 60 and a cutter return spring 64, which extend between the actuator 56 and the lower track guide 45. The actuator 56 has a generally u-shaped cross section for receiving other elements of the dispensing and cutting mechanisms therein and is selectively shiftable between an extended position, shown in FIGS. 2-5, a material advancement position, shown in FIG. 6, and a material-cutting position, shown in FIG. 7.

Figure 3:
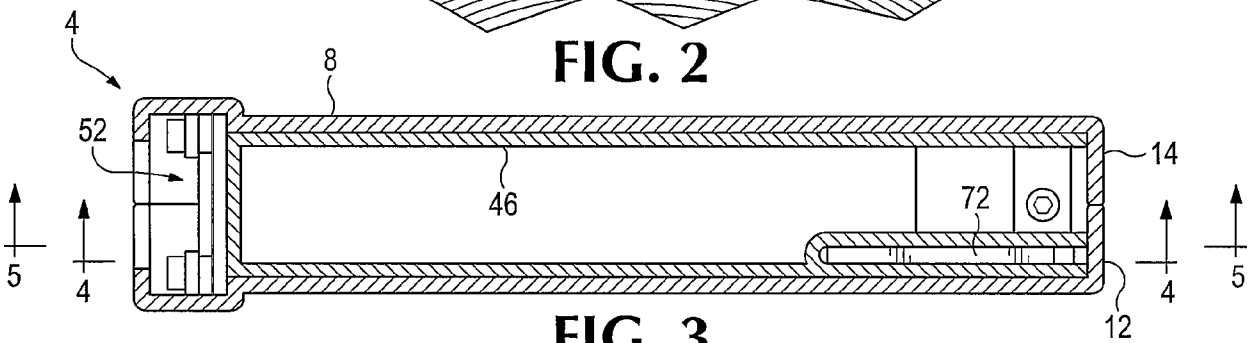
FIG. 3 is a top down cutaway view of the material dispenser of FIG. 2 from the plane labeled 3-3 therein.
Figure 4:
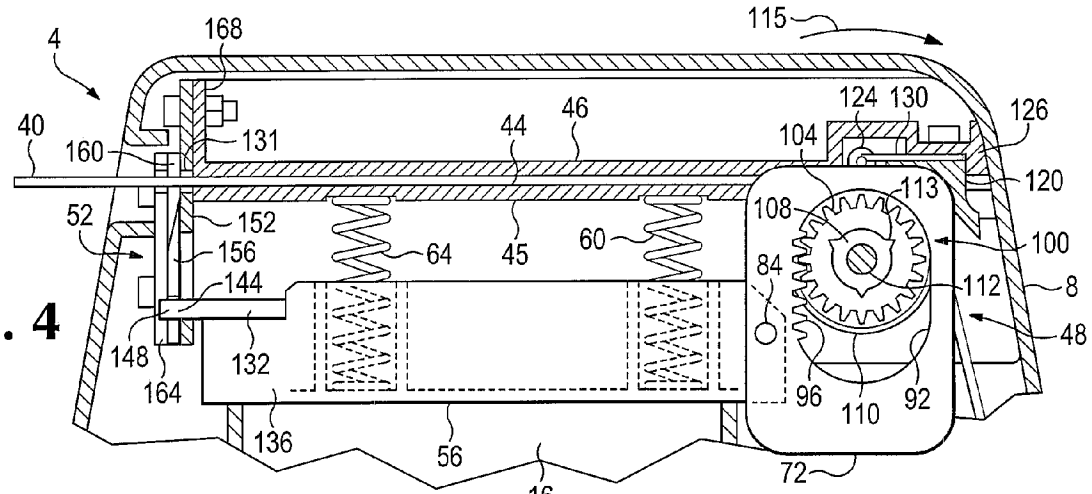
FIG. 4 is a view similar to FIG. 2, but cut away along line 4-4 of FIG. 3 to illustrate the interior of the material advancement mechanism and the cutting mechanism.
Figure 5:
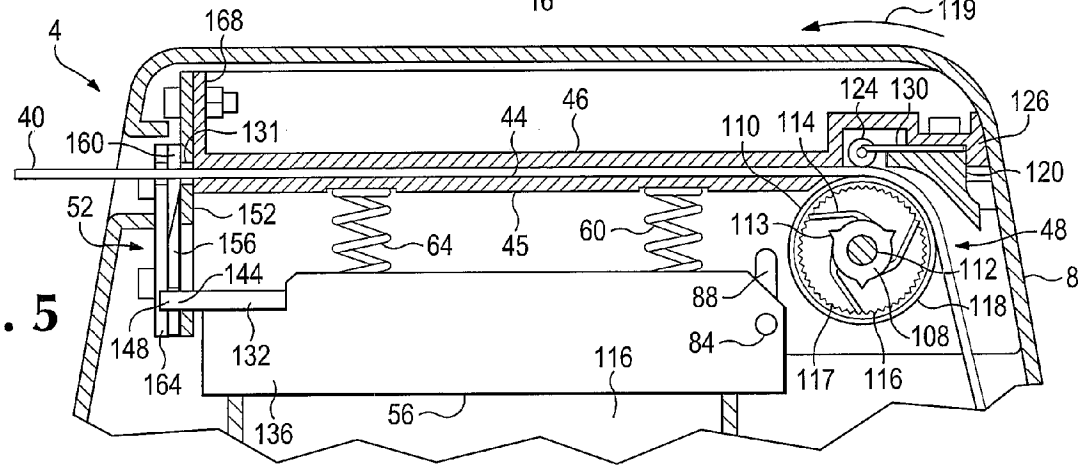
FIG. 5 is a view similar to FIG. 4, but cut away along line 5-5 of FIG. 3 to further illustrate the interior of the material advancement mechanism and the cutting mechanism.

Referring to FIGS. 3-5, the actuator 56 is operable to move a rack plate 72, located at rear end of the actuator, in the direction of arrow 80. The actuator 56 is connected to the rack plate 72 via a connection pin 84. The movement of the connection pin 84, and thus the rack plate 72, is constrained to a limited path by a guide slot 88 formed in the lower track guide 45. The rack plate 72 has an internal perimeter surface including a rack 96. The rack 96 is engaged with a dispensing roller assembly 100, including a pinion wheel 104, a pawl wheel 108, a dispensing roller 110, and an axle pin 112, all rotatable about a common axis defined by the axle pin. The pinion wheel 104 is disposed adjacent to the dispensing roller 110 and the pawl wheel 108 is disposed partially within both the pinion wheel and the dispensing roller. The pawl wheel 108 includes drive members 113 engaged with the pinion wheel 104 and pawls 114 engaged with a ratchet-toothed inner surface 116 of the dispensing roller 110.

Figure 2:
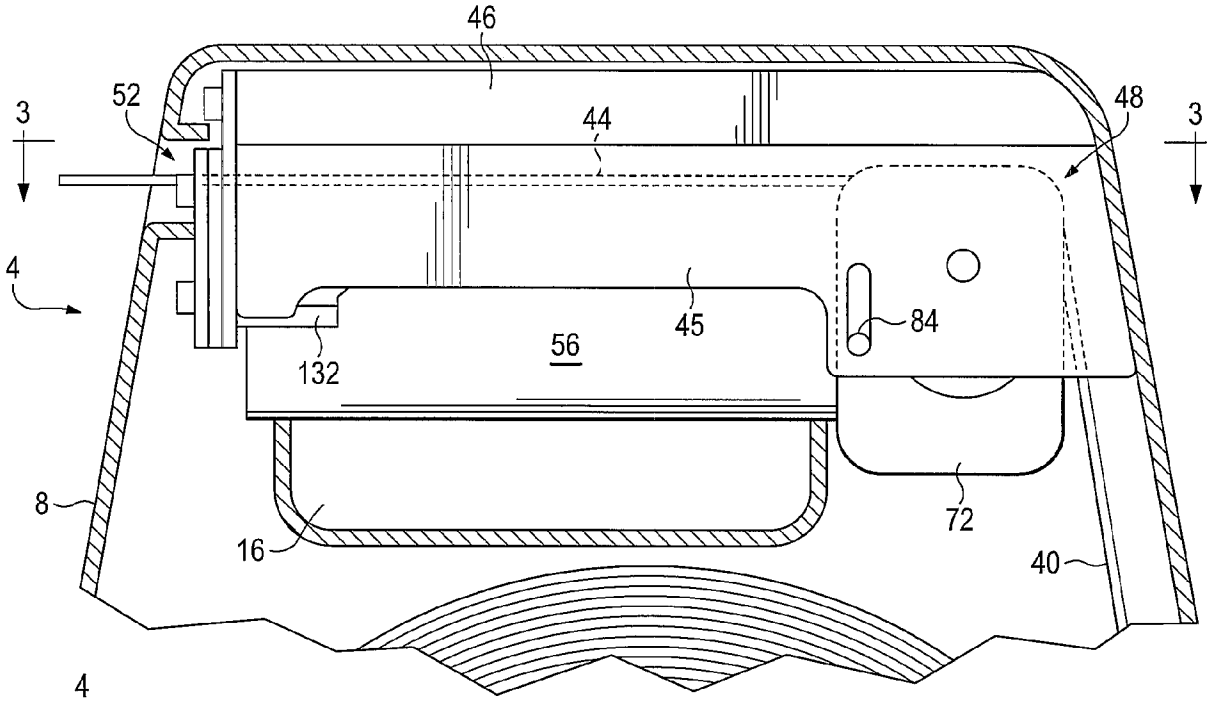
FIG. 2 is a partial side elevation view of the material dispenser of FIG. 1, with the trigger handle thereof shown in a standby position.
Figure 6:
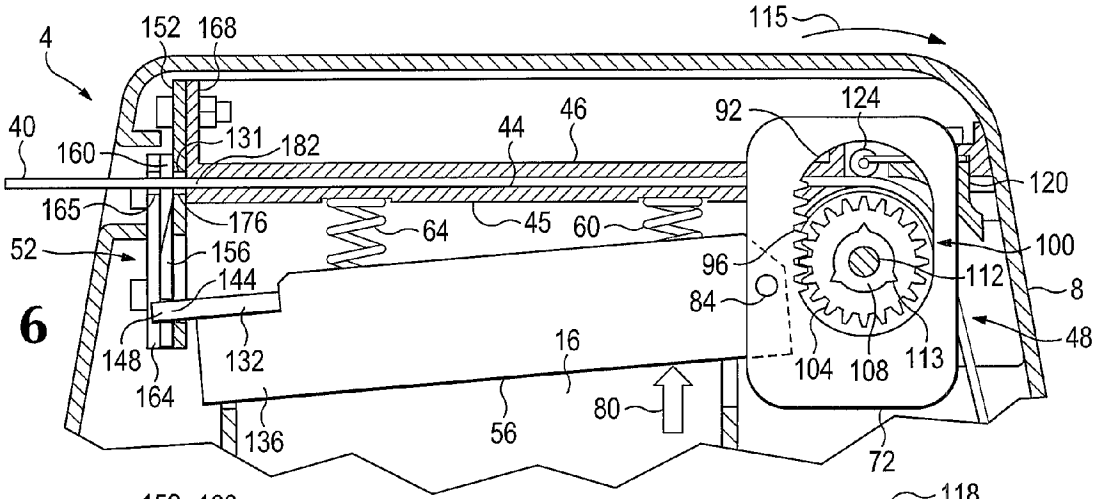
FIG. 6 is a view similar to FIG. 4, but with the activation handle shown in a material advancement position.

When an appropriate external force is applied to the actuator 56, such from a user gripping the actuator and squeezing its rear end, the actuator moves from the position shown in FIG. 2 toward the position shown in FIG. 6. The movement of the actuator 56 loads the material advancement spring 60 and causes the rack plate 72 to move in the direction of arrow 80 along the limited path defined by the guide slot 88. The rack 96 is engaged with the pinion wheel 104 and thus the movement of the rack plate 72 causes the pinion wheel to rotate in a clockwise, loading direction, indicated by arrow 115. The rotation of the pinion wheel 104 in turn rotates the pawl wheel 108 via the drive members 113. The pawls 114 and teeth 117 are oriented so that the pawls do not engage the teeth when the pawl wheel 110 rotates in the loading direction and therefore the dispensing roller remains stationary. However, when the external force is removed from the actuator 56 the material advancement spring 60 will tend to return to its extended state, causing the actuator 56 to return elastically towards the standby position shown in FIG. 2. The rack 96 engages the pinion wheel 104, causing the pinion wheel and the pawl wheel 108 to rotate in a counter-clockwise, material advancement direction, indicated by the arrow 119 in FIG. 5. The pawl members 114 now engage with the inner surface 116 of the dispensing roll 110, causing the dispensing roll to coaxially rotate along with the pinion wheel 104 and pawl wheel 108 in the counter-clockwise, advancement direction 119.

The dispensing roller 110 may be fabricated in a manner to facilitate gripping of the material 40, such as by having a textured outer surface 118 to provide frictional contact between the dispensing roller 110 and the material 40. Alternatively, the dispensing roller may further be provided with protrusions (not shown) for interdigitating with perforations 42 in the material 40. Advancement of the material 40 is further facilitated by a directional guide member 120 and a pressure roller 124 located adjacent to the upper track guide 46. The directional guide member 120 directs a leading section of material 40 between the dispensing roller 110 and the pressure roller 124. The pressure roller 124 is biased towards dispensing roller 110 by a spring 130 in order to maintain the material 40 in frictional contact with the dispensing roller 110. Rotation of the dispensing roller in the advancement direction will cause a corresponding advancement of the material 40 along the track 44, through an opening 131 at the end of the track, toward cutting mechanism 52.

Figure 7:
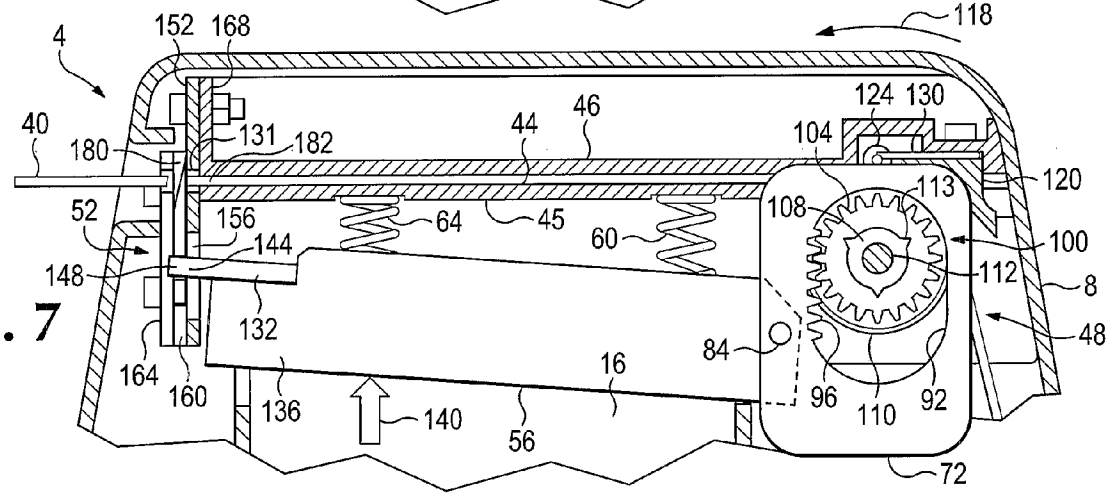
FIG. 7 is a view similar to FIG. 6, but with the activation handle shown in a material cutting position.
Figure 8:
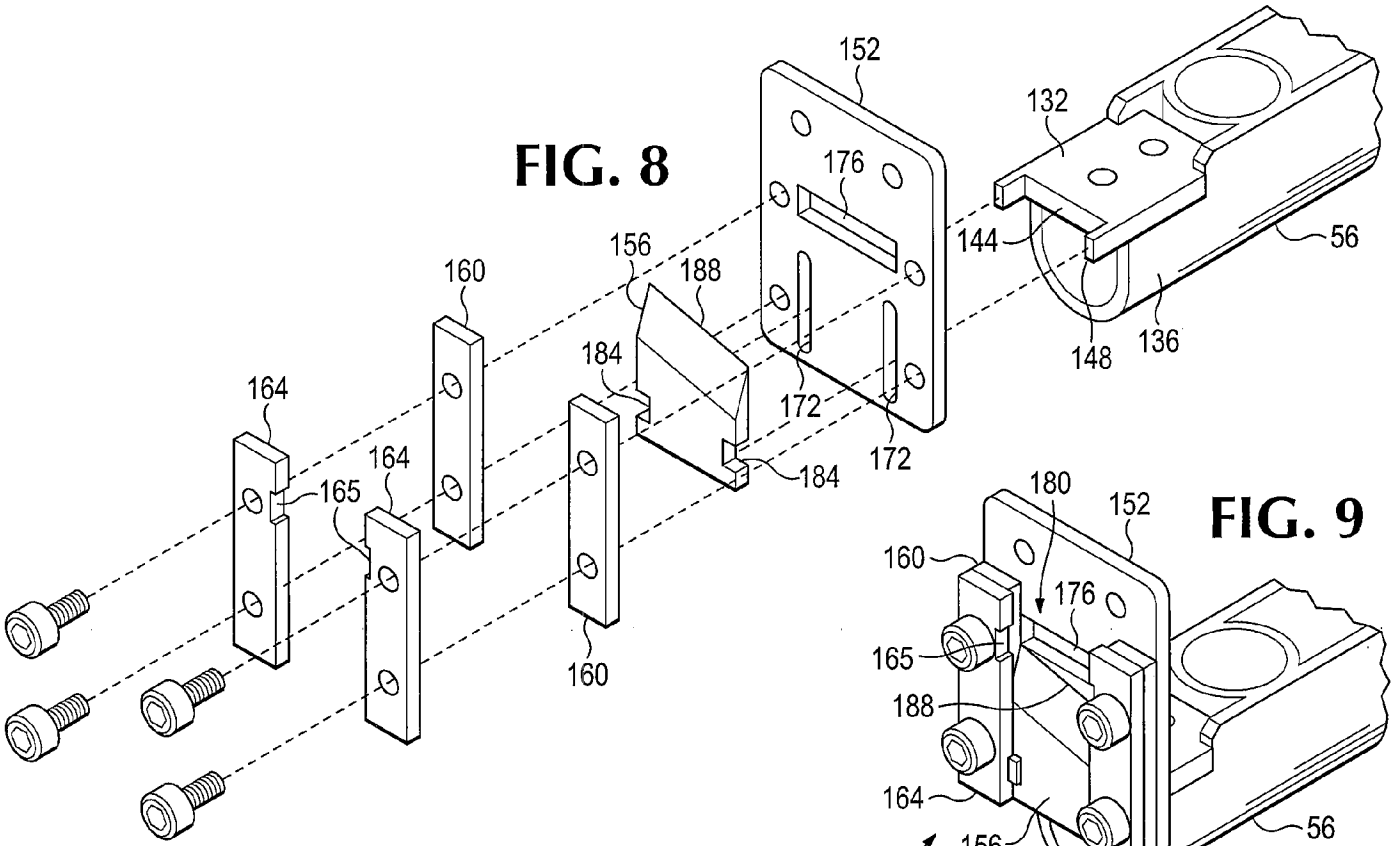
FIG. 8 is an exploded perspective view showing the components of a cutting mechanism of the material dispenser.
Figure 9:
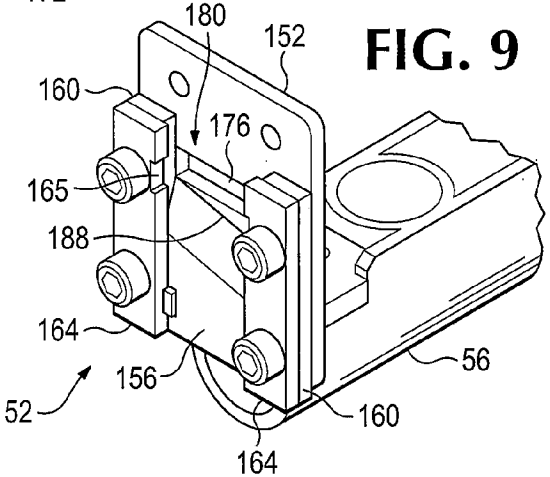
FIG. 9 is a perspective view showing the cutting mechanism shown in FIG. 8 in its assembled configuration.

Referring to FIGS. 4, and 7-9, actuator 56 is further operable to move a drive member 132, located at a forward end 136 of the actuator 56, in the direction of arrow 140 in FIG. 7. A forward end 144 of the drive member 132 is engaged with the material cutting mechanism 52 via engagement members 148 formed in the drive member. The material cutting mechanism 52 includes a blade guide plate 152, a blade 156, a pair of blade guide spacers 160, and a pair of blade retention members 164. The blade retention members also define material guide notches 165 that can help constrain the material 40 as it is being cut by the blade 156. The components of the material cutting mechanism 52 are preferably made of stainless steel, or a similarly durable, corrosion resistant material. The mechanism 52 is affixed to a forward end 168 of the upper track guide 46. The blade guide plate 152 is fashioned to define two guide slots 172, for aligning the engagement members with the blade 156, and a material passageway 176. The blade guide plate 152, the pair of blade guide spacers 160, and the pair of blade retention members 164 form a limited travel path 180 for the blade 156. The mechanism 52 is positioned such that the material passageway 176 is aligned with an opening 182 at the end of the track 44. The blade 156 is formed with a pair of guide notches 184 and a cutting edge 188 and is located adjacent to the blade guide plate 152 and between the blade guide spacers 160. When the actuator 56 is in the stand-by position, the cutting edge 188 is disposed adjacent to material passageway 176. The engagement members 148 pass through the guide slots 172 and engage the blade 156 via guide notches 184.

Referring to FIG. 7, when an appropriate external force is applied to the actuator 56, such as by a user gripping the actuator and squeezing the front end, the actuator is moved from the position shown in FIGS. 2 and 3, toward the position shown in FIG. 7. The movement of the trigger 56 loads the material return spring 64 and causes the blade 156 to travel in the direction of arrow 140. The cutting edge 188 will move past the material passageway 176, severing any portion of the material 40 that extends beyond the passageway.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A dispenser for dispensing a selectable amount of material from an amount of stored material, comprising:

(a) a housing having a material track and a material storage area;

(b) a material-advancement mechanism disposed within said housing, said material-advancement mechanism including a dispensing roller having a toothed inner surface, a pawl wheel having a pawl operatively engaged with said toothed inner surface, a pinion wheel drivingly engaged with said pawl wheel, and a rack plate drivingly engaged with said pinion wheel;

(c) a material-cutting mechanism disposed within said housing; and (d) an actuator movably disposed with respect to said housing and having a first end operatively engaged with said material-advancement mechanism and an opposing second end operatively engaged with said material-cutting mechanism and spring-biased to a stand-by position via at least a first spring, said actuator being selectively movable to a material-advancement position, thereby engaging said material-advancement mechanism, and selectively movable to a material-cutting position, thereby engaging said material-cutting mechanism.

2. The dispenser of claim 1, further including a second spring, wherein said actuator is also spring-biased to said stand-by position by said second spring, and selective movement of said actuator to said material-advancement position causes compression of said first spring, and wherein selective movement of said actuator to said material-cutting position causes compression of said second spring.

3. The dispenser of claim 1, wherein during movement of said actuator toward said material-advancement position, said pawl wheel rotates in a first, loading direction without engaging said toothed inner surface and wherein, during movement of said actuator away from said material advancement position, said pawl wheel rotates in a second, material-advancement direction and said pawl engages said toothed inner surface causing said dispensing roller to rotate in said material-advancement direction.

4. The dispenser of claim 1, said material-advancement mechanism further comprising a pressure roller and a pressure roller spring disposed substantially adjacent to said dispensing roller, and wherein said pressure roller spring biases said pressure roller towards said dispensing roller, and wherein said pressure roller and said dispensing roller define a portion of said material track.

5. The dispenser of claim 1, wherein said dispensing roller has an outer surface suitable for frictionally gripping material to be dispensed.

6. The dispenser of claim 1, wherein said material-cutting mechanism includes a blade guide assembly, said blade guide assembly including a guide plate defining an opening adjacent to said material track, and a blade movable along a path defined by said blade guide assembly.

7. The dispenser of claim 6, wherein movement of said actuator toward said material cutting position moves said blade along said path.

8. The dispenser of claim 1, wherein said dispensing roller has an outer surface suitable for frictionally gripping material to be dispensed, and wherein shifting said actuator from said material advancement position to said stand-by position causes said dispensing roller to correspondingly rotate.

9. The dispenser of claim 1, wherein said material track includes an upper track member, a lower track member, and a directional guide member, wherein said upper and lower track members and said directional guide member partially define said material track, said material track being disposed to receive a leading portion of a length of stored material and guide said leading portion through said material-advancement mechanism, between said upper and lower track members, through said material-cutting mechanism, and through an exterior opening in said housing.

10. A dispenser for dispensing a selectable amount of material from an amount of stored material, comprising:

(a) a housing having a material track and material storage area;

(b) a material-advancement mechanism disposed within said housing and including a dispensing roller having an engageable inner surface, a pawl wheel having a pawl operatively engaged with said engagable inner surface, a pinion wheel drivingly engaged with said pawl wheel, and a rack plate drivingly engaged with said pinion wheel;

(c) a material-cutting mechanism including a blade guide assembly, said blade guide assembly including a guide plate having an opening communicating with an end of said material track, and a blade movable along a path defined by said blade guide assembly; and (d) an actuator having a first end operatively engaged with said rack plate and an opposing second end operatively engaged with said blade, said actuator being spring-biased to a non-compressed position by first and second springs and selectively movable to a material-advancement position, thereby moving said rack plate, and being selectively movable to a material cutting position, thereby moving said blade;

(e) wherein:

(i) while said actuator is moving toward said material-advancement position, said rack plate rotates said pawl wheel in a loading direction without said pawl engaging said engageable inner surface;

(ii) while said actuator is moving away from said material-advancement position, said rack plate rotates said pawl wheel in an advancement direction and said pawl engages said engageable inner surface, causing said dispensing roller to rotate in said advancement direction; and (iii) while said actuator is moving toward said material-cutting position, said blade moves along said path.

11. The dispenser of claim 10, whereby a selected length of material disposed in said dispenser may be dispensed from said dispenser by selectively moving said actuator from said material advancement position to said stand-by position, thereby operating said material-advancement mechanism, at least once until said selected length of material has passed said material cutting mechanism and then selectively moving said actuator to said material-cutting position, thereby operating said material-cutting mechanism.

* * * * *